US011692771B2

(12) United States Patent
Yamamoto et al.

(10) Patent No.: US 11,692,771 B2
(45) Date of Patent: Jul. 4, 2023

(54) PROCESS AND APPARATUS FOR TREATING LEAN LNG

(71) Applicant: TOYO ENGINEERING CORPORATION, Tokyo (JP)

(72) Inventors: Taisei Yamamoto, Narashino (JP); Yasuyuki Yamamori, Narashino (JP)

(73) Assignee: TOYO ENGINEERING CORPORATION, Tokyo (JP)

( * ) Notice: Subject to any disclaimer, the term of this patent is extended or adjusted under 35 U.S.C. 154(b) by 405 days.

(21) Appl. No.: 16/991,265

(22) Filed: Aug. 12, 2020

(65) Prior Publication Data

US 2021/0063084 A1 Mar. 4, 2021

(30) Foreign Application Priority Data

Aug. 28, 2019 (JP) ..... JP2019-155116

(51) Int. Cl.
*F25J 3/02* (2006.01)

(52) U.S. Cl.
CPC ..... *F25J 3/0214* (2013.01); *F25J 2200/02* (2013.01)

(58) Field of Classification Search
CPC ..... F25J 3/0214; F25J 3/0615; F25J 3/0209; F25J 3/064; F25J 3/0635; F17C 2221/073; F17C 2265/05; F17C 2265/033; F17C 2265/035
See application file for complete search history.

(56) References Cited

U.S. PATENT DOCUMENTS

| | | | | |
|---|---|---|---|---|
| 2,952,984 A | | 9/1960 | Marshall | |
| 3,261,169 A | * | 7/1966 | Harmens | F17C 9/04 62/623 |
| 5,114,451 A | * | 5/1992 | Rambo | F25J 3/0214 62/623 |
| 6,510,706 B2 | | 1/2003 | Stone et al. | |
| 7,216,507 B2 | | 5/2007 | Cuellar et al. | |
| 2005/0066686 A1 | * | 3/2005 | Wilkinson | F25J 3/0242 62/620 |

(Continued)

FOREIGN PATENT DOCUMENTS

JP 2019-085332 A 6/2019

*Primary Examiner* — Jianying C Atkisson
*Assistant Examiner* — For K Ling
(74) *Attorney, Agent, or Firm* — Foley & Lardner LLP

(57) ABSTRACT

A process for obtaining a product gas and product LNG having pressure P1 close to the atmospheric pressure from lean LNG, includes: a) branching the lean LNG to obtain a first flow and a second flow; b) cooling the second flow by using a refrigerant; c) branching a liquid flow derived from the cooled second flow to obtain refrigerant LNG and remaining LNG; d) subjecting the remaining LNG to pressure reduction and gas-liquid separation to obtain a gas phase flow and a liquid phase flow (product LNG) having pressure P1; e) subjecting the refrigerant LNG to pressure reduction; f) using a flow from the step e as the refrigerant; g) joining, before or after the step f, the gas phase flow having pressure P1 to a flow from the step e; h) liquefying a flow resulting from the steps f and g by pressure increase and cooling (through heat exchange with the first flow); i) increasing the first flow in pressure before the step h; j) obtaining the product gas by regasifying the first flow after the steps h and i; and k) joining a flow liquefied in the step h to the second flow.

9 Claims, 3 Drawing Sheets

(56) References Cited

U.S. PATENT DOCUMENTS

| | | | | |
|---|---|---|---|---|
| 2006/0000234 | A1* | 1/2006 | Cuellar | F25J 3/0242 62/620 |
| 2008/0066493 | A1* | 3/2008 | Buijs | F25J 3/0257 62/620 |
| 2008/0264100 | A1* | 10/2008 | Mak | F25J 3/0238 62/621 |
| 2009/0282865 | A1* | 11/2009 | Martinez | F25J 3/0214 62/634 |
| 2010/0287985 | A1* | 11/2010 | Martinez | F25J 3/0238 62/620 |
| 2018/0216877 | A1* | 8/2018 | Dabkowski | F25J 1/0092 |

* cited by examiner

PROCESS AND APPARATUS FOR TREATING LEAN LNG

BACKGROUND OF THE INVENTION

Field of the Invention

The present invention relates to a process and an apparatus for treating lean LNG obtained by separating, from a liquefied natural gas (LNG), natural gas liquids (NGL, containing a hydrocarbon having 2 or more carbon atoms) or a liquefied petroleum gas (LPG, principally containing a hydrocarbon having 3 to 4 carbon atoms).

Description of Related Art

A liquefied natural gas (LNG), which is obtained by liquifying a natural gas in a gas producing country, is exported therefrom, and is received to be stored in an LNG tank in an LNG receiving terminal of a consumer country. After increasing the pressure using a pump, LNG is regasified to be sent to a natural gas pipeline, or is transported in a liquid state, so as to be used as a fuel gas by an end user.

When LNG contains heavy hydrocarbons such as propane, butane and pentane in a large amount, the heating value is high, and hence such LNG may not meet the standards of a natural gas pipeline of a consumption region. Including such a case, there are cases where heavy hydrocarbons are preferably separated and recovered from received LNG, namely, raw material LNG. Therefore, NGL or LPG is extracted from raw material LNG to obtain methane-enriched or methane- and ethane-enriched lean LNG.

A process for separating hydrocarbon from raw material LNG by using a distillation column is disclosed in U.S. Pat. Nos. 6,510,706, 2,952,984 and 7,216,507 and JP2019-85332A.

SUMMARY OF THE INVENTION

In a process for separating hydrocarbon from LNG disclosed in each of U.S. Pat. Nos. 6,510,706, 2,952,984 and 7,216,507 and JP2019-85332A, a comparatively heavy hydrocarbon is extracted from raw material LNG by using a distillation column, and lean LNG having a temperature of about −70 to −105° C. and a pressure of about 2,000 to 3,000 kPaA can be obtained from the distillation column. It is noted that "A" and "G" used in the unit of the pressure mean an absolute pressure and a gauge pressure, respectively.

When such lean LNG is sent to an LNG tank or a tank truck for transportation operated at a pressure close to the atmospheric pressure, however, a large amount of vaporized gas (hereinafter sometimes referred to as "BOG (boil-off gas)") may be generated in some cases. Such BOG generation is caused because enthalpy in the lean LNG has been increased by heat input to the distillation column.

Energy consumption required in pressure increase caused when BOG in a gas state is compressed with a compressor is larger than energy consumption required in pressure increase of a liquid. Therefore, when BOG is generated in a large amount, a large amount of energy is required for treating the BOG.

Destinations of product LNG or product gas can be city gas, LNG transportation by a tank truck, and fuel supply for power generation, and these are different in the required gas heating value. An indication of the gas heating value is, for example, 45 MJ/Nm$^3$ for city gas, 43.5 MJ/Nm$^3$ for LNG transportation by a tank truck, and as for fuel supply for power generation, about 40 MJ/Nm$^3$ although there is no common standard as an absolute value because it depends on a generator. When the heating value of LNG received from a gas producing country is lower than 45 MJ/Nm$^3$, for example, 41 to 43 MJ/Nm$^3$, heating value increase is required for city gas and LNG transportation by a tank truck, and on the other hand, lightened gas may be used for fuel for power generation. Therefore, in the latter case, LNG is heated and separated to obtain rich LNG having a high heating value and lean LNG having a low heating value in some cases.

An object of the present invention is to provide a process and an apparatus for treating lean LNG capable of avoiding generation of BOG or reducing an amount of BOG generated even when lean LNG enriched in methane or enriched in methane and ethane as compared with raw material LNG is sent to a tank or the like operated at a pressure close to the atmospheric pressure.

According to one aspect of the present invention, provided is a process for treating lean LNG for obtaining, from lean LNG enriched in methane or enriched in methane and ethane as compared with raw material LNG, a product gas and a product LNG having a pressure P1 close to the atmospheric pressure, including:

a) branching the lean LNG to obtain lean LNG for product gas and lean LNG for product LNG;

b) cooling the lean LNG for product LNG in a cooler using a refrigerant;

c) branching a liquid flow derived from the lean LNG for product LNG having been cooled in the step b to obtain refrigerant LNG to be used as the refrigerant, and remaining LNG corresponding to a balance;

d) subjecting the remaining LNG to pressure reduction and gas-liquid separation to obtain a gas phase flow having the pressure P1 and a liquid phase flow having the pressure P1 as the product LNG;

e) subjecting the refrigerant LNG to pressure reduction;

f) using a flow from the step e as the refrigerant of the cooler;

g) joining, before or after the step f, the gas phase flow having the pressure P1 to the flow from the step e;

h) subjecting a flow resulting from the step f and the step g to pressure increase and cooling through heat exchange with the lean LNG for product gas to liquefy the flow resulting from the step f and the step g;

i) subjecting the lean LNG for product gas before being used for the heat exchange of the step h to pressure increase;

j) regasifying the lean LNG for product gas after the step h and the step i to obtain the product gas; and k) joining the flow having been liquefied in the step h to the lean LNG for product LNG obtained in the step a.

According to another aspect of the present invention, provided is an apparatus for treating lean LNG for obtaining, from lean LNG enriched in methane or enriched in methane and ethane as compared with raw material LNG, a product gas and product LNG having a pressure P1 close to the atmospheric pressure, including:

first branching means for branching the lean LNG to obtain lean LNG for product gas and lean LNG for product LNG;

a cooler for cooling the lean LNG for product LNG by using a refrigerant;

second branching means for branching a liquid flow derived from the lean LNG for product LNG having been cooled by the cooler to obtain refrigerant LNG to be used as the refrigerant, and remaining LNG corresponding to a balance;

pressure reducing and gas-liquid separating means for subjecting the remaining LNG to pressure reduction and gas-liquid separation to obtain a gas phase flow having the pressure P1 and a liquid phase flow having the pressure P1 as the product LNG;

a pressure reducer for refrigerant LNG for reducing a pressure of the refrigerant LNG;

a line for introducing a flow from the pressure reducer for refrigerant LNG to the cooler as the refrigerant;

first joining means for joining the gas phase flow having the pressure P1 to the flow from the pressure reducer for refrigerant LNG, upstream or downstream from the cooler with reference to a flowing direction of the flow from the pressure reducer for refrigerant LNG;

a compressor and a heat exchanger for subjecting a flow obtained from downstream one of the cooler and the first joining means with reference to the flowing direction of the flow from the pressure reducer for refrigerant LNG to pressure increase and cooling through heat exchange with cold energy of the lean LNG for product gas to liquefy the flow obtained from the downstream one;

a pump for increasing a pressure of the lean LNG for product gas upstream from the heat exchanger with reference to a flowing direction of the lean LNG for product gas;

a vaporizer for regasifying the lean LNG for product gas downstream from the heat exchanger and downstream from the pump with reference to the flowing direction of the lean LNG for product gas to obtain the product gas; and second joining means for joining the flow having been liquefied by the compressor and the heat exchanger to the lean LNG for product LNG obtained by the first branching means.

According to the present invention, a process and an apparatus for treating lean LNG capable of avoiding generation of BOG or reducing an amount of BOG generated even when lean LNG enriched in methane or enriched in methane and ethane as compared with raw material LNG is sent to a tank or the like operated at a pressure close to the atmospheric pressure are provided.

DETAILED DESCRIPTION OF PREFERRED EMBODIMENTS

Figure 1:
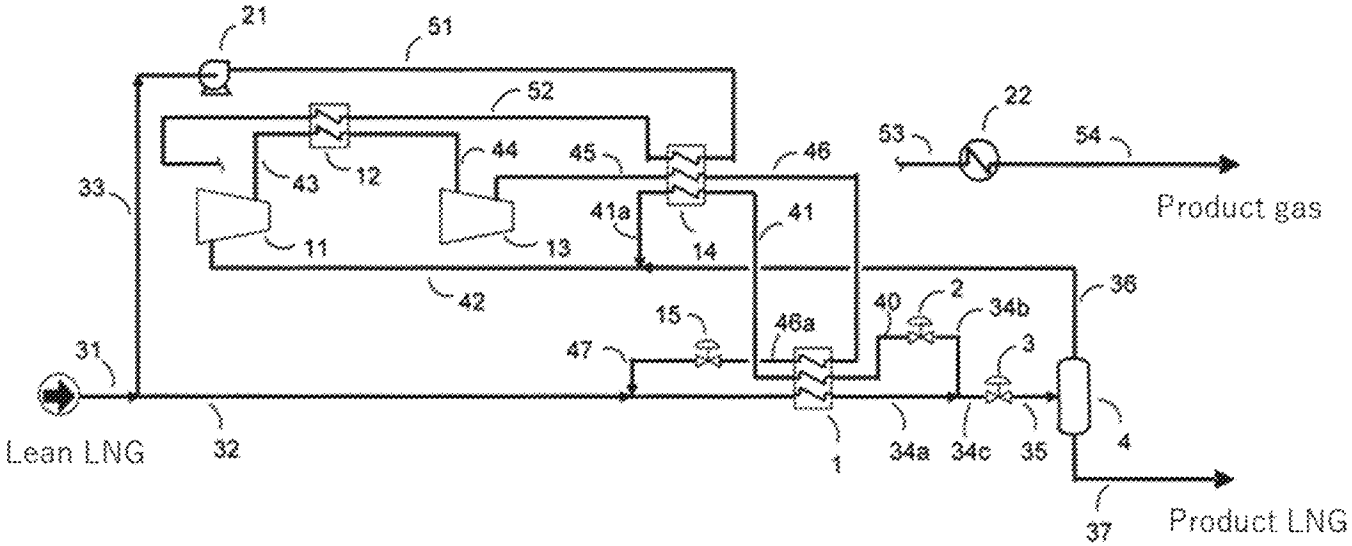
FIG. 1 is a process flow chart for illustrating one embodiment of a process for treating lean LNG of the present invention.

In the present invention, a product gas and a product LNG are obtained from lean LNG enriched in methane or enriched in methane and ethane as compared with raw material LNG. The product LNG has pressure P1 close to the atmospheric pressure. Now, embodiments of the present invention will be described with reference to the accompanying drawings, and it is noted that the present invention is not limited to these embodiments.

[Lean LNG]

Lean LNG can be obtained by subjecting raw material LNG received in a consumption region to heating, gas-liquid separation and liquefaction treatment to enrich methane, or methane and ethane therein. A part of the raw material LNG (liquid) is regasified by the heating to obtain a gas-liquid two-phase flow, and when this gas-liquid two-phase flow is subjected to the gas-liquid separation, a gas fraction enriched in methane or enriched in methane and ethane as compared with the raw material LNG, and a liquid fraction (NGL) enriched in heavier components can be obtained. When this gas fraction is liquefied, lean LNG can be obtained. When the liquid fraction is further subjected to the heating, the gas-liquid separation and the liquefaction treatment, LPG can be also obtained. Other components remaining after taking LPG out can be appropriately used for combustion or the like. In this manner, since the raw material LNG is heated in producing the lean LNG, the enthalpy is increased as described above.

[Product Gas and Product LNG]

The product gas is a gas obtained by regasifying the lean LNG, and can be sent through a natural gas pipeline. The product LNG is a liquid obtained by reducing the enthalpy of the lean LNG by cooling, and then reducing the pressure to pressure P1 close to the atmospheric pressure. The product LNG can be sent to an LNG tank or a tank truck for transportation. Pressure P1 is typically a pressure obtained by adding a pressure loss caused in sending the product LNG to an operating pressure of the destination (the LNG tank or the tank truck for transportation). Pressure P1 is a pressure of, for example, about 5 to 50 kPaG.

Embodiment 1

Now, a process for treating lean LNG according to one embodiment of the present invention will be described with reference to FIG. 1.

This treatment process includes the following steps a to k:

a) Step of branching lean LNG 31 to obtain lean LNG 33 for product gas and lean LNG 32 for product LNG First branching means used for performing this branching can be formed by appropriately branching a pipe. Lean LNG 31 is branched in consideration of demands of end users of the product LNG and the product gas. A branching ratio can be adjusted by appropriate means such as a valve (a pressure reducing valve used as a pressure reducer) or pressure increasing means (a pump or a compressor).

b) Step of cooling lean LNG 32 for product LNG in first cooler 1 using refrigerant First cooler 1 can be equipped with a heat-exchange structure between lean LNG 32 for product LNG and a refrigerant (stream 40).

In this cooling, for example, the temperature of LNG in a liquid state at about −105° C. is cooled to about −150° C. This cooling is designated also as subcooling. Therefore, first cooler 1 functions as a subcooler for the lean LNG for product LNG. This cooling is provided for reducing the enthalpy in the lean LNG.

c) Step of branching liquid flow derived from lean LNG 34*a* for product LNG having been cooled in step b to obtain refrigerant LNG 34*b* to be used as refrigerant in first cooler 1 and remaining LNG 34*c* corresponding to the balance Second branching means used for performing this branching can be formed by appropriately branching a pipe. A branching ratio is determined, for example, so that refrigerant LNG 34*b* can supply an amount of cold energy necessary for cooling lean LNG 32 for product LNG to, for example, about −150° C. in step b. A branching ratio can be adjusted by appropriate means such as a valve (a pressure reducing valve used as a pressure reducer) or pressure increasing means (a pump or a compressor).

The liquid flow derived from LNG 34*a* for product LNG having been cooled in step b contains at least a part of LNG 34*a* for product LNG. In the present embodiment, in step c, the whole amount of the lean LNG for product LNG having been cooled in step b is branched, and thus, the refrigerant LNG and the remaining LNG are obtained. For this purpose, a line for introducing, to the second branching means, the whole amount of the lean LNG (34*a*) for product LNG having been cooled by first cooler 1 is used.

d) Step of subjecting remaining LNG 34*c* to pressure reduction and gas-liquid separation to obtain gas phase flow 36 having pressure P1 and liquid phase flow 37 having pressure P1 as product LNG By the pressure reduction performed in this step, a part of the fluid to be reduced in pressure is vaporized. Pressure reducing and gas-liquid separating means used for performing the pressure reduction and the gas-liquid separation includes pressure reducer 3 for remaining LNG and gas-liquid separator 4 for remaining LNG. Remaining LNG 34*c* is reduced in pressure by pressure reducer 3 for remaining LNG to pressure P1 so as to vaporize a part thereof, and gas-liquid two-phase flow 35 thus obtained is separated by gas-liquid separator 4 for remaining LNG. Gas phase flow (vaporized gas) 36 having pressure P1 is obtained from a top portion of gas-liquid separator 4 for remaining LNG, and liquid phase flow 37 having pressure P1 is obtained from a bottom portion thereof. Liquid phase flow 37 is driven away as the product LNG to be stored in an LNG tank. As pressure reducer 3 for remaining LNG, an appropriate pressure reducing valve can be used.

e) Step of reducing refrigerant LNG 34*b* in pressure

This step is performed by using pressure reducer 2 for refrigerant LNG. Also as pressure reducer 2 for refrigerant LNG, an appropriate pressure reducing valve can be used. In this step, refrigerant LNG 34*b* is reduced in pressure typically to a pressure close to the atmospheric pressure (equivalent to pressure P1). Through the pressure reduction performed in this step, a part of refrigerant LNG 34*b* is vaporized to obtain a gas-liquid two-phase flow (stream 40).

f) Step of using flow from step e as refrigerant of first cooler 1

This step is performed by using a line (a line of stream 40 in FIG. 1) for introducing, as a refrigerant, a flow from step e, namely, a flow from pressure reducer 2 for refrigerant LNG, to first cooler 1. This flow (stream 40) is heated in first cooler 1. Thus, the whole of this flow can be changed into a gas.

g) Step of joining gas phase flow 36 having pressure P1 to flow from step e before or after step f This step is performed by using first joining means for joining gas phase flow 36 having pressure P1 to a flow from pressure reducer 2 for refrigerant LNG, upstream or downstream (with reference to a flowing direction of the flow from pressure reducer 2 for refrigerant LNG) from first cooler 1. The first joining means can be formed by appropriately joining pipes.

Joining Portion

In the embodiment illustrated in FIG. 1, the flow from step e (stream 40) is used as the refrigerant in step f (stream 41), and is further used as the refrigerant in second heat exchanger 14 (stream 41*a*), and then gas phase flow 36 is joined thereto. In other words, gas phase flow 36 is joined to the flow from pressure reducer 2 for refrigerant LNG downstream from first cooler 1 and second heat exchanger 14 with reference to the flowing direction of the flow from pressure reducer 2 for refrigerant LNG. For recovering cold energy held by gas phase flow 36 as in Embodiment 2 described below, however, gas phase flow 36 may be joined to the flow from pressure reducer 2 for refrigerant LNG, before step f, that is, upstream from first cooler 1 with reference to the flowing direction of the flow from pressure reducer 2 for refrigerant LNG. Alternatively, although not illustrated in drawings, gas phase flow 36 may be joined to the flow from pressure reducer 2 for refrigerant LNG after step f and before being used as the refrigerant in second heat exchanger 14, namely, downstream from first cooler 1 and upstream from second heat exchanger 14 with reference to the flowing direction of the flow from pressure reducer 2 for refrigerant LNG.

h) Step of liquefying flow resulting from step f and step g by subjecting flow (stream 42) resulting from step f and step g to pressure increase and cooling by heat exchange with lean LNG for product gas This step is performed by using a compressor and a heat exchanger for liquefying a flow (stream 42) obtained from downstream one of first cooler 1 and the first joining means with reference to the flowing direction of the flow from pressure reducer 2 for refrigerant LNG by subjecting the flow (stream 42) obtained from the downstream one to pressure increase and cooling through heat exchange with cold energy of the lean LNG for product gas. Stream 42 is typically a gas, and the flow is wholly condensed and subcooled. In this step, the cold energy of the lean LNG for product gas is recovered.

Pressure Increase and Cooling Performed in Two Stages

In the embodiment illustrated in FIG. 1, the pressure increase and the cooling performed in this step are performed in two stages. Specifically, the pressure increase of this step is performed first by first compressor 11, and then by second compressor 13. In other words, a compressor used in this step includes first compressor 11 and second compressor 13 disposed downstream from first compressor 11 with reference to the direction of a flow having been compressed by first compressor 11. First compressor 11 and second compressor 13 may be, but not limited to, compressors sharing a common shaft.

The cooling of this step is performed, by using the cold energy of lean LNG 33 for product gas, by cooling discharged fluid 45 of the second compressor, and then cooling discharged fluid 43 of the first compressor. In other words, a heat exchanger used in this step includes first heat exchanger (compressor first stage cooler) 12 for cooling discharged fluid 43 of first compressor 11, and second heat exchanger (compressor second stage cooler) 14 for cooling discharged fluid 45 of second compressor 13. With reference to a flowing direction of the lean LNG for product gas, second heat exchanger 14 is disposed upstream from first heat exchanger 12.

As for stream 42, for example, this flow is compressed by first compressor 11 to 780 kPaA (stream 43), is then cooled by first heat exchanger 12 to −49.8° C. (stream 44), is then compressed by second compressor 13 to 4,100 kPaA (stream 45), and is then cooled by second heat exchanger 14 to −94.0° C. to obtain a liquefied flow (stream 46). As for lean LNG 33 for product gas, this flow is increased in pressure by pump 21 (stream 51), is used as a refrigerant in second heat exchanger 14 to recover the cold energy thereof (stream 52), and is then used as a refrigerant in first heat exchanger 12 to recover the cold energy thereof (stream 53).

Water Cooling and Air Cooling

Although not illustrated in drawings, at least one of discharged fluid 43 of first compressor 11 and discharged fluid 45 of second compressor 13 can be cooled by using a water-cooled or air-cooled heat exchanger for purposes of reducing the power of the compressor. After the water cooling or air cooling, discharged fluid 43 of first compressor 11 can be cooled in first heat exchanger 12 by using the cold energy of the lean LNG for product gas. After the water cooling or air cooling, discharged fluid 45 of second compressor 13 can be cooled in second heat exchanger 14 by using the cold energy of the lean LNG for product gas.

i) Step of increasing pressure of the lean LNG for product gas before being used as refrigerant in heat exchange in step h This step is performed by using a pump for increasing the pressure of the lean LNG for product gas upstream (with reference to the flowing direction of the lean LNG for product gas) from the heat exchanger used in step h. This pressure increase is performed for obtaining a pressure (9,461 kPaA in Example 1) suitable for sending product gas 54 to a natural gas pipeline. Upstream (with respect to the flowing direction of the lean LNG for product gas) from heat exchangers 12 and 14, lean LNG 33 for product gas is increased in pressure by pump 21. LNG 51 for product gas thus increased in pressure is used as a refrigerant in second heat exchanger 14 and subsequently in first heat exchanger 12.

j) Step of regasifying lean LNG 53 for product gas resulting from step h and step i to obtain product gas 54

This step is performed by using vaporizer 22 for regasifying the lean LNG for product gas (stream 53) downstream from pump 21 and downstream from heat exchangers 12 and 14 with reference to the flowing direction of the lean LNG for product gas to obtain product gas 54. Product gas 54 thus obtained is sent to a natural gas pipeline.

Vaporizer 22 can include a heat exchange structure using, as a heating source, an external heating medium of 0° C. or more, such as seawater or air.

k) Step of joining flow having been liquefied in step h to lean LNG 32 for product LNG obtained in step a This step can be performed by using second joining means for joining the flow having been liquefied by the compressor and the heat exchanger used in step h to lean LNG 32 for product LNG obtained by the first branching means. This joining means can be formed by appropriately joining pipes. Through this step, the refrigerant LNG is recycled.

Before the joining of step k, the liquefied flow can be further cooled. Thereafter, the resultant flow can be appropriately reduced in pressure to the pressure of lean LNG 32 for product LNG obtained in step a. In the embodiment illustrated in FIG. 1, the liquefied flow (stream 46) obtained by second heat exchanger 14 is first cooled in first cooler 1 by the refrigerant LNG of stream 40 to obtain stream 46*a*. Subsequently, stream 46*a* is reduced in pressure by pressure reducer 15 for recycled LNG (stream 47), and is then joined to lean LNG 32 for product LNG. As pressure reducer 15 for recycled LNG, an appropriate pressure reducing valve can be used.

Figure 3:
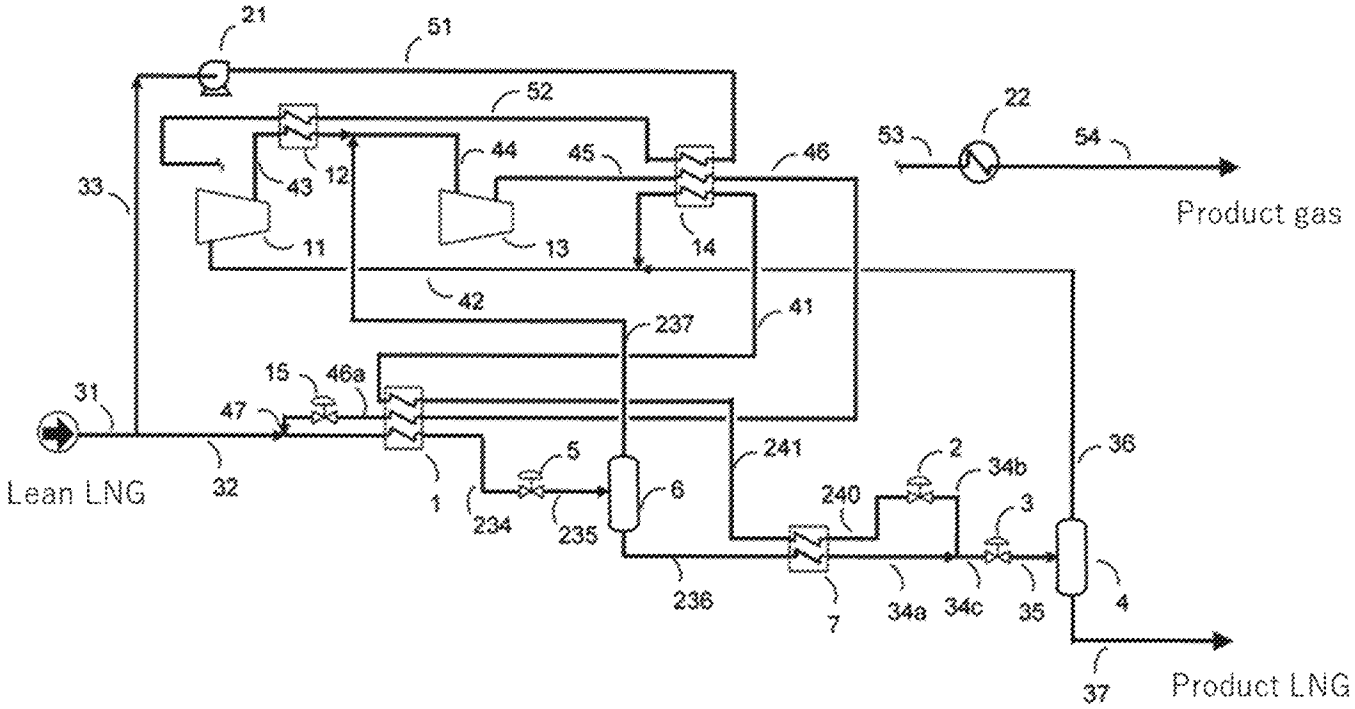
FIG. 3 is a process flow chart for illustrating still another embodiment of the process for treating lean LNG of the present invention.

Cooling, Pressure Reduction and Gas-Liquid Separation Performed in Multiple Stages In the embodiment illustrated in FIG. 1, the cooling, the pressure reduction and the gas-liquid separation of the lean LNG for product LNG is performed in a single stage by using first cooler 1, pressure reducer 3 and gas-liquid separator 4. As illustrated in FIG. 3, however, the cooling, the pressure reduction and the gas-liquid separation of the lean LNG for product LNG can be performed in a plurality of stages, for example, two stages. For example, in step c, the lean LNG for product LNG having been cooled in step b (stream 234) is subjected to the pressure reduction and the gas-liquid separation, so as to obtain a gas phase flow (stream 237) having pressure P2 higher than pressure P1 and a liquid phase flow (stream 236) having pressure P2, and thereafter, the liquid phase flow having pressure P2 is cooled. Then, the thus cooled liquid phase flow (stream 34*a*) having pressure P2 is branched to obtain the refrigerant LNG (34*b*) and the remaining LNG (34*c*). For this purpose, pressure reducing and gas-liquid separating means for performing the pressure reduction and the gas-liquid separation, cooler (heat exchanger) 7 for cooling the liquid phase flow having pressure P2, and a line for introducing the cooled liquid phase flow having pressure P2 to the second branching means are used. As the pressure reducing and gas-liquid separating means, pressure reducer (appropriate pressure reducing valve) 5 and gas-liquid separator 6 can be used.

Specifically, the lean LNG for product LNG is cooled by first cooler 1 to, for example, about −110° C. in step b (stream 234), then first pressure reduction is performed by pressure reducer 5 (stream 235), and subsequently, first gas-liquid separation is performed by gas-liquid separator 6 to obtain the gas phase flow (stream 237) and the liquid phase flow (stream 236) both having pressure P2 higher than pressure P1. Thereafter, the liquid phase flow having pressure P2 thus obtained is cooled by second cooler 7 to about −150° C. (stream 34*a*), and this stream is branched (streams 34*b* and 34*c*). One of the branched liquid phase flows (stream 34*c*) can be further subjected to second pressure reduction by pressure reducer 3 and second gas-liquid separation by gas-liquid separator 4 to obtain a gas phase flow (stream 36) and a liquid phase flow (stream 37) both having pressure P1. The other of the liquid phase flows branched (stream 34*b*) is subjected to pressure reduction by pressure reducer 2 (stream 240), is then used in second cooler 7 as a refrigerant for cooling the liquid phase flow (stream 236) having pressure P2 obtained by the first gas-liquid separation (stream 241), and is then used as a refrigerant in first cooler 1.

Pressure P2 is lower than the pressure of the lean LNG (stream 234) at the outlet of first cooler 1 and is higher than pressure P1. The gas phase flow (stream 237) obtained by the first gas-liquid separation is sucked by second compressor 13, and hence pressure P2 is equivalent to a discharge pressure of first compressor 11.

When the pressure increase and the cooling of stream 42 are performed in two stages in step h as in the embodiment illustrated in FIG. 3, the gas phase flow (stream 237) having pressure P2 can be joined to the discharged fluid of the first compressor before (stream 43) or after (stream 44) cooling in step h (by first heat exchanger 12). A flow obtained by this joining is compressed thereafter by second compressor 13.

Alternatively, the gas phase flow (stream 237) having pressure P2 can be used as a refrigerant for cooling the lean LNG for product LNG (stream 32) in step b. For this purpose, a heat exchange structure for cooling the lean LNG for product LNG by the gas phase flow (stream 237) having pressure P2 can be provided in first cooler 1 or separately from first cooler 1. When this heat exchange structure is provided separately from first cooler 1, this heat exchange structure can be provided upstream or downstream from first cooler 1 with reference to the flowing direction of the flow of the lean LNG for product LNG. The gas phase flow (stream 237) having pressure P2 can be joined, after thus used as a refrigerant, to the discharged fluid of the first compressor before (stream 43) or after (stream 44) cooling in step h (by first heat exchanger 12).

Alternatively, in parallel to step h, or after step h, the gas phase flow (stream 237) having pressure P2 can be used as a refrigerant for cooling the flow resulting from step f and step g (for example, stream 45, 46 or 46*a*). For this purpose, a heat exchange structure for cooling the flow resulting from step f and step g (for example, stream 45, 46 or 46*a*) by the gas phase flow having pressure P2 can be provided in second heat exchanger 14, or separately from second heat exchanger 14. When this heat exchange structure is provided separately from second heat exchanger 14, this heat exchange structure can be provided upstream or downstream from first cooler 1 with respect to a flowing direction of the refrigerant LNG. The heat exchange structure works as a heat exchanger for stream 46 when it is provided upstream from first cooler 1, and for stream 46*a* when provided downstream. The gas phase flow (stream 237) having pressure P2 can be joined, after thus used as a refrigerant, to the discharged fluid of the first compressor before (stream 43) or after (stream 44) cooling in step h (by first heat exchanger 12).

Use of External Refrigerant

An external refrigerant can be used for cooling the flow resulting from step f and step g (for example, discharged fluid 45 of second compressor 13). For this purpose, a heat exchange structure with the external refrigerant such as a propane refrigerant can be provided in second heat exchanger 14 or upstream from second heat exchanger 14.

Thus, the temperature of the gas flowing to second heat exchanger 14 can be reduced to, for example, about −35° C.

Embodiment 2

Embodiment 2 will now be described with reference to FIG. 2. Common matters to Embodiment 1 will not be described here.

In this embodiment, in the step g, a gas phase flow having pressure P1 obtained in step d is joined, before the step f, to a flow from the step e. For this purpose, first joining means is provided so as to join gas phase flow 36 having pressure P1 to a flow (stream 140*a*) from pressure reducer 2 for refrigerant LNG, upstream from first cooler 1 with reference to the flowing direction of the refrigerant LNG. A flow (stream 140*b*) obtained by the joining is used as a refrigerant of step b in first cooler 1. A flow (stream 141) after being used as a refrigerant in first cooler 1 is used as a refrigerant for cooling of stream 45 in second heat exchanger 14. A flow (stream 142) after being used as a refrigerant in second heat exchanger 14 is supplied to first compressor 11.

[Miscellaneous]

As for each of the above-described devices such as a cooler, a heat exchanger, a gas-liquid separator, a pump, a compressor, and a pressure reducer, various structures and materials known in the field of LNG can be appropriately used. The respective devices can be connected through appropriate lines, and these lines can be formed by using appropriate pipe materials.

According to the present invention, supplied lean LNG is branched to lean LNG for product gas and lean LNG for product LNG to be respectively treated. For cooling the lean LNG for product LNG, cold energy of the lean LNG for product LNG itself (a portion to be recycled as refrigerant LNG) is used. For recondensation of vaporized refrigerant LNG, cold energy of the lean LNG for product gas is used. Therefore, without employing external refrigerant, the product LNG can be lowered in temperature and pressure. Accordingly, a liquid fraction can be obtained as the product LNG (stream 37) without generating BOG, or with merely a small amount of BOG generated.

EXAMPLES

Example 1

Process simulation was performed with respect to the process according to Embodiment 1 illustrated in FIG. 1. Conditions of the lean LNG (stream 31) are shown in Table 1 (wherein the composition was set to 0.45 mol % of nitrogen, 90.34 mol % of methane, and 9.21 mol % of ethane). It is noted that a unit "kg-mol" means "$10^3$ mol".

It is noted that heat exchange between a cryogenic apparatus and an external ambient environment is assumed as sufficiently small and hence is not considered in calculation. Since the heat exchange with the external can be sufficiently reduced by providing a commercially available cold insulation in a cryogenic apparatus, the assumption is regarded adequate.

Lean LNG 31 is supplied at a temperature of −104.6° C. and a pressure of 2,015 kPaA to be branched to lean LNG 32 for product LNG and lean LNG 33 for product gas. Here, 40 mol % of the lean LNG is sent to stream 32 to be supplied as the product LNG, and 60 mol % of the lean LNG is sent to stream 33 to be supplied as the product gas.

Lean LNG 32 for product LNG thus branched is joined to LNG (stream 47) of −108.5° C. having been recondensed in a recycle line for recycling refrigerant LNG, and is then sent to first cooler 1 to be subcooled to −148.8° C. The thus subcooled LNG (stream 34*a*) is branched, so that 30 mol % thereof (stream 34*b*) be reduced in pressure to 150 kPaA in pressure reducer 2 for refrigerant LNG. Through this pressure reduction, the refrigerant LNG is reduced in temperature to −156.6° C. (stream 40), is used as a refrigerant in first cooler 1 to be increased in temperature to −96.0° C. (stream 41), and is subsequently supplied as a refrigerant to second heat exchanger 14 to be increased in temperature to −49.6° C. (stream 41*a*). 70 mol % (stream 34*c*) of the subcooled LNG (stream 34*a*) is sent to pressure reducer 3 for remaining LNG, and is reduced in pressure to 150 kPaA to obtain gas-liquid two-phase flow 35. This gas-liquid two-phase flow is separated in gas-liquid separator 4 for remaining LNG to two phases, and thus, product LNG is obtained in the form of a liquid fraction from the bottom portion (stream 37).

Vaporized gas 36 obtained from the top portion of gas-liquid separator 4 for remaining LNG is joined to the refrigerant LNG (stream 41*a*) at the outlet of second heat exchanger 14 to obtain stream 42.

Stream 42 is increased in pressure to 780 kPaA in a discharge line (stream 43) of first compressor 11, is then cooled from 65.1° C. to −47.5° C. in first heat exchanger 12, is then increased in pressure to 4,100 kPaA in a discharge line (stream 45) of second compressor 13, and thereafter, is cooled from 89.9° C. to −94.0° C. to be recondensed in second heat exchanger 14. The thus recondensed recycled LNG (stream 46) is subcooled in first cooler 1 to −108.0° C. (stream 46*a*), is then reduced in pressure to the pressure of lean LNG 32 for product LNG in pressure reducer 15 for recycled LNG (stream 47), and is recycled to the line of lean LNG 32 for product LNG.

Lean LNG 33 for product gas is increased in pressure by pump 21 to 9,461 kPaA (stream 51), is increased in temperature in second heat exchanger 14 from −96.0° C. to −49.6° C. (stream 52), and is then increased in temperature in first heat exchanger 12 to −35.5° C. (stream 53). Stream 53 is regasified in vaporizer 22 (stream 54) to be sent to the pipeline at 0° C. and 9,411 kPaA.

Material balance and energy consumption of this example are summarized in Tables 1 and 2. It is noted that among the respective streams illustrated in FIG. 1, streams 36, 41, 41*a*, 42, 43, 44, 45, and 54 are in the form of a gas. Streams 31, 32, 33, 51, 52, 34*a*, 34*b*, 34*c*, 37, 46, 46*a*, and 47 are in the form of a liquid. The other streams are in the form of a gas-liquid two-phase flow.

TABLE 1

| Material Balance in Example 1 (corresponding to FIG. 1) | | | | | | |
|---|---|---|---|---|---|---|
| Stream | 31 | 32 | 33 | 37 | 46 | 54 |
| Temperature (° C.) | −104.6 | −104.6 | −104.6 | −156.6 | −94.0 | 0.0 |
| Pressure (kPaA) | 2,015 | 2,015 | 2,015 | 150 | 4,100 | 9,411 |
| Flow Rate (kg-mol/hr) | | | | | | |
| Nitrogen | 47 | 19 | 28 | 19 | 48 | 28 |
| Methane | 9,524 | 3,810 | 5,714 | 3,810 | 1,993 | 5,714 |
| Ethane | 971 | 388 | 582 | 388 | 166 | 582 |
| Total | 10,542 | 4,217 | 6,325 | 4,217 | 2,207 | 6,325 |

TABLE 2

| Energy Consumption in Example 1 (corresponding to FIG. 1) | | | |
|---|---|---|---|
| | First Stage Gas Compressor | Second Stage Gas Compressor | Pump for Product Gas |
| Necessary Power (kW) | 2,793 | 2,918 | 858 |

Example 2

Figure 2:
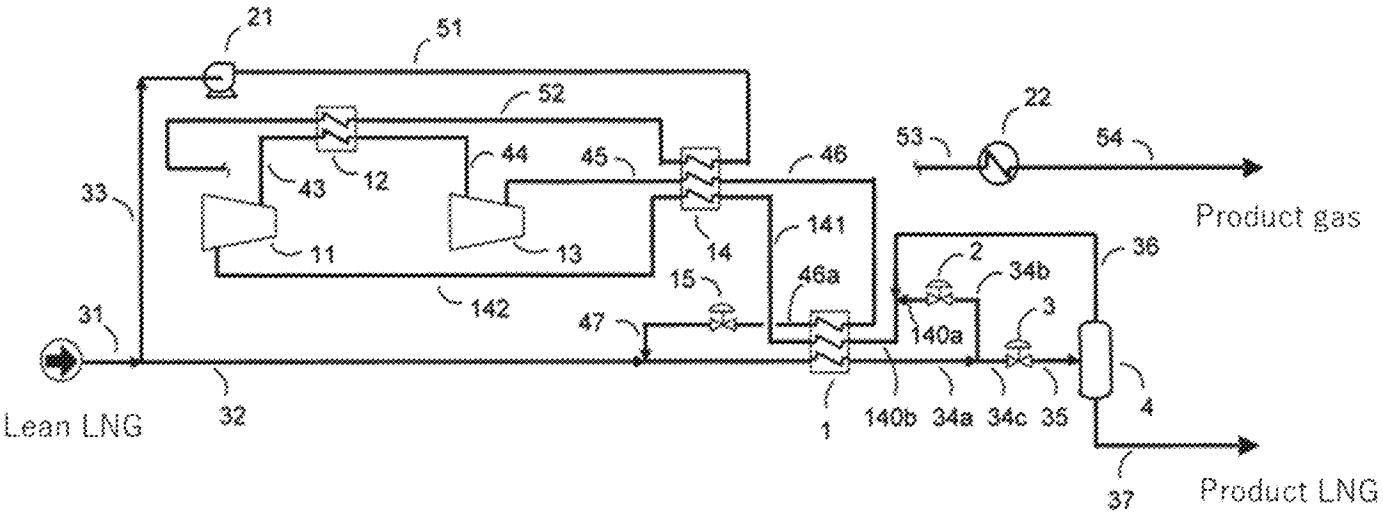
FIG. 2 is a process flow chart for illustrating another embodiment of the process for treating lean LNG of the present invention.

Process simulation was performed with respect to the process according to Embodiment 2 illustrated in FIG. 2.

In the same manner as in Example 1, lean LNG 31 is branched to lean LNG 32 for product LNG and lean LNG 33 for product gas.

Lean LNG 32 for product LNG thus branched is joined to LNG (stream 47) of −108.5° C. having been recondensed in the recycle line for recycling the refrigerant LNG, and is then sent to first cooler 1 to be subcooled to −151.0° C. LNG thus subcooled (stream 34*a*) is branched, and 30 mol % thereof (stream 34*b*) is reduced in pressure to 150 kPaA in pressure reducer 2 for refrigerant LNG. Through this pressure reduction, the refrigerant LNG is reduced in temperature to −156.6° C. to be used as a refrigerant in first cooler 1. 70 mol % (stream 34*c*) of the subcooled LNG (stream 34*a*) is sent to pressure reducer 3 for remaining LNG, and is reduced in pressure to 150 kPaA to obtain gas-liquid two-phase flow 35. The gas-liquid two-phase flow is separated in gas-liquid separator 4 for remaining LNG to two phases, and thus, the product LNG is obtained from the bottom portion in the form of a liquid fraction (stream 37).

Vaporized gas 36 obtained from the top portion of gas-liquid separator 4 for remaining LNG is joined to the refrigerant LNG (stream 140*a*) at the outlet of pressure reducer 2 for refrigerant LNG, stream 140*b* thus joined is used as a refrigerant in first cooler 1 to be increased in temperature to −96.0° C. (stream 141), and is then used as a refrigerant in second heat exchanger 14 to be increased in temperature to −51.9° C. (stream 142).

Stream 142 is increased in pressure to 780 kPaA in the discharge line (stream 43) of first compressor 11, is then cooled from 79.6° C. to −49.5° C. (stream 44) in first heat exchanger 12, is then increased in pressure to 4,100 kPaA in the discharge line (stream 45) of second compressor 13, and is subsequently cooled from 86.4° C. to −94.0° C. to be recondensed in second heat exchanger 14. The recycled LNG thus recondensed (stream 46) is subcooled to −108.0° C. (stream 46*a*) in first cooler 1, and is then reduced in pressure to the pressure of lean LNG 32 for product LNG (stream 47) in pressure reducer 15 for recycled LNG to be recycled to the line of lean LNG 32 for product LNG.

Lean LNG 33 for product gas is increased in pressure to 9,461 kPaA (stream 51) by pump 21, is increased in temperature to −51.9° C. (stream 52) in second heat exchanger 14, and is then increased in temperature to −36.6° C. (stream 53) in first heat exchanger 12. Stream 53 is regasified (stream 54) in vaporizer 22 to be sent to the pipeline at 0° C. and 9,411 kPaA.

Material balance and energy consumption of this example are summarized in Tables 3 and 4. It is noted that among the respective streams illustrated in FIG. 2, streams 36, 141, 142, 43, 44, 45, and 54 are in the form of a gas. Streams 31, 32, 33, 51, 52, 34*a*, 34*b*, 34*c*, 37, 46, 46*a*, and 47 are in the form of a liquid. The other streams are in the form of a gas-liquid two-phase flow.

TABLE 3

| Material Balance in Example 2 (corresponding to FIG. 2) | | | | | | |
|---|---|---|---|---|---|---|
| Stream | 31 | 32 | 33 | 37 | 46 | 54 |
| Temperature (° C.) | −104.6 | −104.6 | −104.6 | −156.6 | −94.0 | 0.0 |
| Pressure (kPaA) | 2,015 | 2,015 | 2,015 | 150 | 4,100 | 9,411 |
| Flow Rate (kg-mol/hr) | | | | | | |
| Nitrogen | 47 | 19 | 28 | 19 | 37 | 28 |
| Methane | 9,524 | 3,810 | 5,714 | 3,810 | 1,896 | 5,714 |
| Ethane | 971 | 388 | 582 | 388 | 166 | 582 |
| Total | 10,542 | 4,217 | 6,325 | 4,217 | 2,099 | 6,325 |

TABLE 4

| Energy Consumption in Example 2 (corresponding to FIG. 2) | | | |
|---|---|---|---|
| | First Stage Gas Compressor | Second Stage Gas Compressor | Pump for Product Gas |
| Necessary Power (kW) | 2,787 | 2,742 | 858 |

REFERENCE SIGNS LIST

1: first cooler
2: pressure reducer for refrigerant LNG
3: pressure reducer for remaining LNG
4: gas-liquid separator for remaining LNG
5: pressure reducer
6: gas-liquid separator
7: second cooler
11: first compressor
12: first heat exchanger (compressor first stage cooler)
13: second compressor
14: second heat exchanger (compressor second stage cooler)
15: pressure reducer for recycled LNG
21: pump
22: vaporizer

What is claimed is:

1. A process for treating lean LNG for obtaining, from lean LNG enriched in methane or enriched in methane and ethane as compared with raw material LNG, a product gas and a product LNG having a pressure P1 close to the atmospheric pressure, comprising:

a) branching the lean LNG to obtain lean LNG for product gas and lean LNG for product LNG;

b) cooling the lean LNG for product LNG in a cooler using a refrigerant;

c) branching a liquid flow derived from the lean LNG for product LNG having been cooled in the step b to obtain refrigerant LNG to be used as the refrigerant, and remaining LNG corresponding to a balance;

d) subjecting the remaining LNG to pressure reduction and gas-liquid separation to obtain a gas phase flow having the pressure P1 and a liquid phase flow having the pressure P1 as the product LNG;

e) subjecting the refrigerant LNG to pressure reduction;

f) using a flow from the step e as the refrigerant of the cooler;

g) joining, before or after the step f, the gas phase flow having the pressure P1 to the flow from the step e;

h) subjecting a flow resulting from the step f and the step g to pressure increase and cooling through heat exchange with the lean LNG for product gas to liquefy the flow resulting from the step f and the step g;

i) subjecting the lean LNG for product gas before being used for the heat exchange of the step h to pressure increase;

j) regasifying the lean LNG for product gas after the step h and the step i to obtain the product gas; and k) joining the flow having been liquefied in the step h to the lean LNG for product LNG obtained in the step a.

2. The process according to claim 1, wherein, in the step g, the gas phase flow having the pressure P1 obtained in the step d is joined, before the step f, to the flow from the step e.

3. The process according to claim 1, wherein, in the step h, the pressure increase is performed by using a first compressor, and then using a second compressor, and cold energy of the lean LNG for product gas is used to cool a discharged fluid from the second compressor, and subsequently to cool a discharged fluid from the first compressor.

4. The process according to claim 1, wherein, in the step h, the pressure increase is performed by using a first compressor, and then using a second compressor, and at least one of a discharged fluid from the first compressor and a discharged fluid from the second compressor is cooled by using a water-cooled or air-cooled heat exchanger.

5. The process according to claim 1, wherein, in the step c, a whole amount of the lean LNG for product LNG having been cooled in the step b is branched to obtain the refrigerant LNG and the remaining LNG.

6. The process according to claim 1, wherein, in the step c, the lean LNG for product LNG having been cooled in the step b is subjected to pressure reduction and gas-liquid separation to obtain a gas phase flow and a liquid phase flow both having a pressure P2 higher than the pressure P1, and the liquid phase flow having the pressure P2 is cooled and then branched to obtain the refrigerant LNG and the remaining LNG.

7. The process according to claim 6, wherein, in the step h, the pressure increase is performed by using a first compressor and then a second compressor, and cold energy of the lean LNG for product gas is used to cool a discharged fluid of the second compressor, and subsequently to cool a discharged fluid of the first compressor, and the gas phase flow having the pressure P2 is joined to the discharged fluid of the first compressor.

8. The process according to claim 6, wherein the gas phase flow having the pressure P2 is used as a refrigerant for cooling the lean LNG for product LNG in the step b.

9. The process according to claim 1, wherein, in the step h, the pressure increase is performed by using the first compressor and then the second compressor, and cold energy of the lean LNG for product gas is used to cool a discharged fluid of the second compressor, and subsequently to cool a discharged fluid of the first compressor, and the discharged fluid of the second compressor is cooled by using an external refrigerant.

* * * * *